US009450313B2

(12) United States Patent
Tsai

(10) Patent No.: US 9,450,313 B2
(45) Date of Patent: Sep. 20, 2016

(54) ELECTRICAL CONNECTOR WITH TERMINAL CLAMPS FOR IMPROVED SOLDERING QUALITY

(71) Applicant: LOTES CO., LTD, Keelung (TW)

(72) Inventor: Shang Ju Tsai, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 14/802,749

(22) Filed: Jul. 17, 2015

(65) Prior Publication Data

US 2016/0072198 A1 Mar. 10, 2016

(30) Foreign Application Priority Data

Sep. 4, 2014 (CN) ..... 2014 2 0507788 U

(51) Int. Cl.

| | |
|---|---|
| ***H01R 4/10*** | (2006.01) |
| ***H01R 4/02*** | (2006.01) |
| ***H01R 13/41*** | (2006.01) |
| *H01R 12/57* | (2011.01) |
| *H01R 12/71* | (2011.01) |

(52) U.S. Cl.

CPC ..... *H01R 4/027* (2013.01); *H01R 13/41* (2013.01); *H01R 12/57* (2013.01); *H01R 12/716* (2013.01)

(58) Field of Classification Search

CPC ..... H01R 4/027; H01R 4/02; H01R 13/02; H01R 13/2442

USPC ..... 439/877, 878, 348

See application file for complete search history.

(56) References Cited

U.S. PATENT DOCUMENTS 7,125,293 B2 * 10/2006 Mongold ..... H01R 12/57 439/874
7,467,949 B2 * 12/2008 Liao ..... H01R 13/2435 439/66
8,016,623 B2 * 9/2011 Ju ..... H01R 13/112 439/342
8,052,454 B2 * 11/2011 Polnyi ..... H01R 12/57 439/342
8,118,603 B2 * 2/2012 Ho ..... H01R 12/57 439/626
8,147,256 B2 * 4/2012 Jin ..... H01R 12/52 439/83
8,177,574 B2 * 5/2012 Ju ..... H01R 24/00 439/342
8,192,206 B1 * 6/2012 Ju ..... H01R 12/57 439/66
8,342,873 B2 * 1/2013 Liao ..... H01R 12/57 439/342
8,430,682 B2 * 4/2013 Liao ..... H01R 12/57 439/342
8,708,716 B1 * 4/2014 Ho ..... H01R 12/57 439/83
2011/0318966 A1 * 12/2011 Huo ..... H01R 12/716 439/626
2012/0252274 A1 * 10/2012 Ju ..... H01R 12/716 439/626

* cited by examiner

*Primary Examiner* — Tulsidas C Patel
*Assistant Examiner* — Peter G Leigh
(74) *Attorney, Agent, or Firm* — Locke Lord LLP; Tim Tingkang Xia, Esq.

(57) ABSTRACT

An electrical connector includes a body and at least one terminal. The body has a top surface and a bottom surface opposite to each other, multiple receiving holes running through the body from the top surface to the bottom surface, and at least two protruding blocks protruding downward from the bottom surface and located around each of the receiving hole. A gap exists between the two protruding blocks. Each of the protruding blocks has a stopping surface toward the gap. The terminal is disposed in the receiving hole. The terminal has a fixing portion and two clamping arms extending downward from the fixing portion along a plate surface for clamping a tin ball. Bottom ends of the two clamping arms are located in the gap. The stopping surfaces are configured to stop the clamping arms and prevent the clamping arms from moving in a plate thickness direction.

14 Claims, 5 Drawing Sheets

ELECTRICAL CONNECTOR WITH TERMINAL CLAMPS FOR IMPROVED SOLDERING QUALITY

CROSS-REFERENCE TO RELATED APPLICATION

This non-provisional application claims priority under 35 U.S.C. §119(a) on Patent Application No. 201420507788.0 filed in P.R. China on Sep. 4, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector that can stably clamp a tin ball to ensure soldering.

BACKGROUND OF THE INVENTION

A conducting terminal of a conventional electrical connector generally fixes a tin ball in a pre-soldering manner, that is, first the tin ball is soldered to the tail portion of the terminal, and then the tin ball is soldered to a circuit board. This practice involves many soldering procedures, thereby increasing costs.

In order to solve the foregoing problem, an electrical connector including a terminal for clamping a tin ball by using a clamping arm without the need of pre-soldering occurs in the industry. As disclosed in U.S. Pat. No. 8,277,230, an electrical connector includes an insulating body. Multiple receiving holes run through the insulating body. Multiple conducting terminals are disposed in the receiving holes. Multiple protruding blocks are disposed on a lower surface of the insulating body and located at the periphery of the receiving hole, where two adjacent protruding blocks are located at two opposite sides of the receiving hole. The conducting terminal includes a base portion. An elastic arm extends upward from the base portion. A contact portion is disposed at an end of the elastic arm. Two soldering arms extend downward from the base portion, and a gap exists between the two soldering arms and is used for mounting a tin ball. Each of the soldering arms has a bended extending arm and a clamping end extending from the extending arm. When the tin ball is loaded between two clamping ends, the two clamping ends clamp the widest portion (that is, the portion at the diameter) of the tin ball, so that the tin ball is stably clamped by the two clamping ends. Meanwhile, the two opposite protruding blocks are disposed around the periphery of each of the receiving holes. The two clamping ends and the two protruding blocks jointly urge the tin ball, thereby limiting the tin ball in transverse and longitudinal directions, and ensuring the location of the tin ball. Compared with the conventional manner of pre-soldering a tin ball, the foregoing manner of clamping the tin ball by using the clamping end of the conducting terminal saves the soldering process, and is more simple and convenient in manufacturing.

The two protruding blocks and the two clamping ends respectively urge the tin ball in two directions. A gap exists between the two protruding blocks, and the two clamping ends are located in the gap, and can be deformed in the gap. When the tin ball enters a space between the two clamping ends, the soldering arm is propped by the tin ball. Due to a force to which the soldering arm is subject, the soldering arm is not only propped open in a clamping direction, but also may be propped in a direction perpendicular to the clamping direction. In this case, the two clamping ends may be deformed in the gap in the direction perpendicular to the clamping direction. That is, the two clamping ends are dislocated or deflected, so that a distance between the two clamping ends is greater than the diameter of the tin ball, the two soldering arms cannot clamp the widest portion of the tin ball, the tin ball easily falls off, and therefore the soldering quality of the electrical connector cannot be ensured.

Therefore, a heretofore unaddressed need exists in the art to address the aforementioned deficiencies and inadequacies.

SUMMARY OF THE INVENTION

In one aspect, the present invention is directed to an electrical connector whose terminal stably clamps a tin ball to ensure soldering quality.

In one embodiment, an electrical connector includes a body. The body has a top surface and a bottom surface disposed opposite to each other. Multiple receiving holes are formed from the top surface to the bottom surface and run through the body. At least two protruding blocks protrude downward from the bottom surface and are located around the receiving hole. A gap exists between the two protruding blocks, and each of the protruding blocks is provided with a stopping surface toward the gap. At least one terminal is disposed in the receiving hole. The terminal has a fixing portion. Two clamping arms extend downward from the fixing portion along a plate surface and clamp a tin ball. Bottom ends of the two clamping arms are located in the gap. The stopping surfaces can stop the clamping arms and prevent the clamping arms from moving in a plate thickness direction.

In one embodiment, a distance between the clamping arm and the stopping surface is less than the thickness of the clamping arm.

In one embodiment, each one of the protruding blocks has a depressed portion depressed from the stopping surface in a direction away from the other one of the protruding blocks. The depressed portions and the clamping arms jointly define an accommodating space used for holding the tin ball.

In one embodiment, the accommodating space is formed into an octagon, and two protruding blocks and the clamping arms jointly clamp the tin ball.

In one embodiment, the clamping arms are elastically deformable in the gap. When the tin ball is mounted to the clamping arms, the clamping arms are elastically deformed outward in a direction perpendicular to the plate thickness direction.

In one embodiment, the clamping arm includes an extending portion connected to the fixing portion and a clamping portion extending downward from a lower end of the extending portion. The clamping portions clamp the tin ball.

In one embodiment, the extending portions are located in the receiving hole, and the clamping portions extend out from the bottom surface and are located in the gap.

In one embodiment, hook portions facing each other protrude from ends of the two clamping arms, and the hook portions are inserted into the tin ball.

In one embodiment, a connecting arm is provided between the two clamping arms. The connecting arm is connected to the two clamping arms, to increase the strength thereof. The connecting arm is located below the fixing portion, and a space exists between the connecting arm and the fixing portion.

In one embodiment, the connecting arm includes two connecting portions respectively connected to the two clamping arms, and an included angle is formed between the two connecting portions.

In one embodiment, the connecting arm is V-shaped.

In one embodiment, at least one protruding portion protrudes in the receiving hole, and the protruding portion stops the top of the tin ball, to prevent the tin ball from excessively moving upward.

In one embodiment, the clamping arms and the fixing portion are coplanar.

In one embodiment, two clamping arms are symmetrical about the center of the tin ball from the bottom view.

Compared with the related art, certain embodiments of the present invention, among other things, have the following beneficial advantages.

The gap exists between the two protruding blocks. Each of the protruding blocks is provided with the stopping surface toward the gap. Bottom ends of the two clamping arms are located in the gap. The stopping surfaces can stop the clamping arms and prevent the clamping arms from moving in a plate thickness direction. By means of the stopping action of the stopping surfaces, it can be ensured that when the clamping arms are propped by the tin ball, the clamping arms are only deformed in the clamping direction, but is not deformed in the plate thickness direction, so as to avoid a dislocation or deflection problem, so that the clamping arms can stably clamp the tin ball, to ensure the soldering quality of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
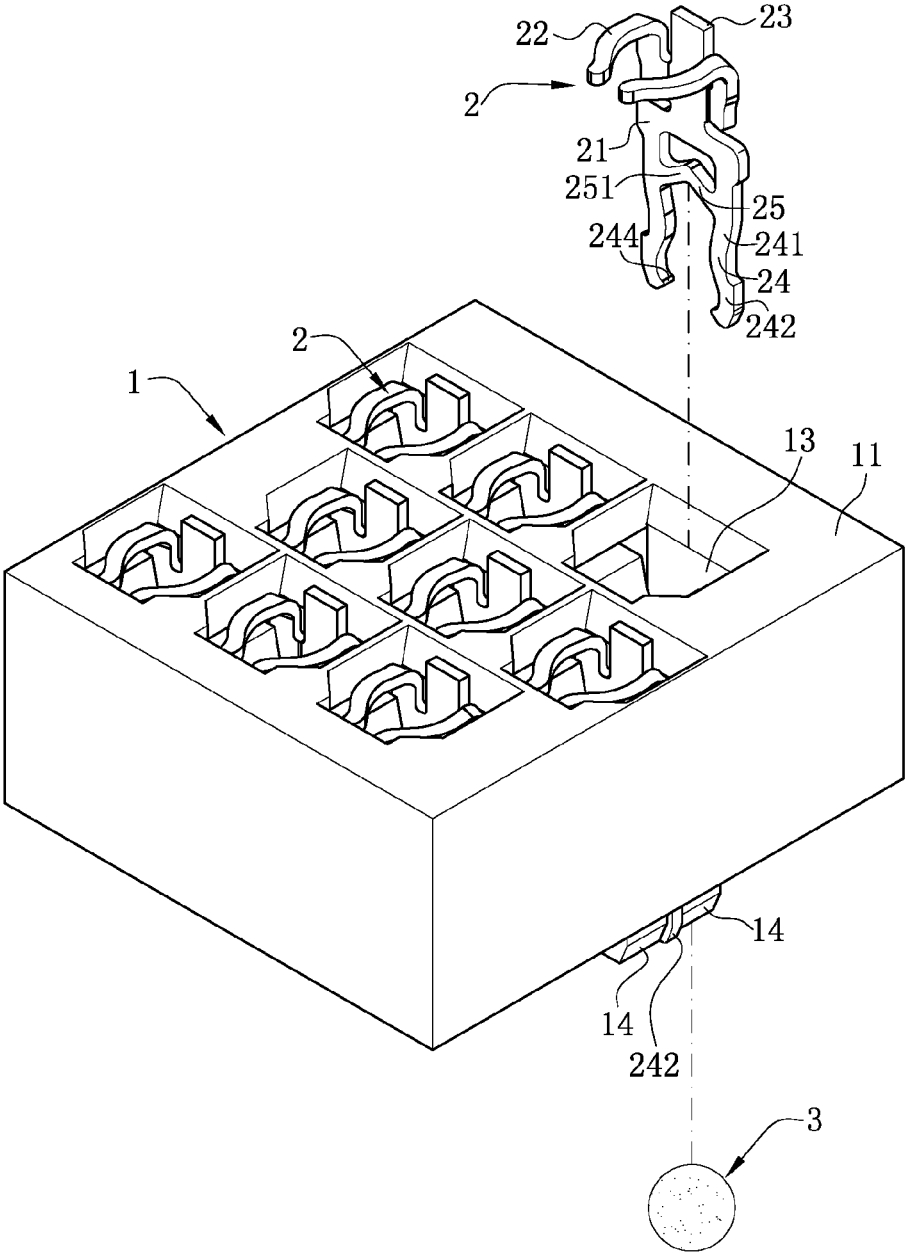
FIG. 1 is a three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

As shown in FIG. 1, an electrical connector according to one embodiment of the present invention includes a body 1, and multiple terminals 2 are disposed in the body 1.

Figure 2:
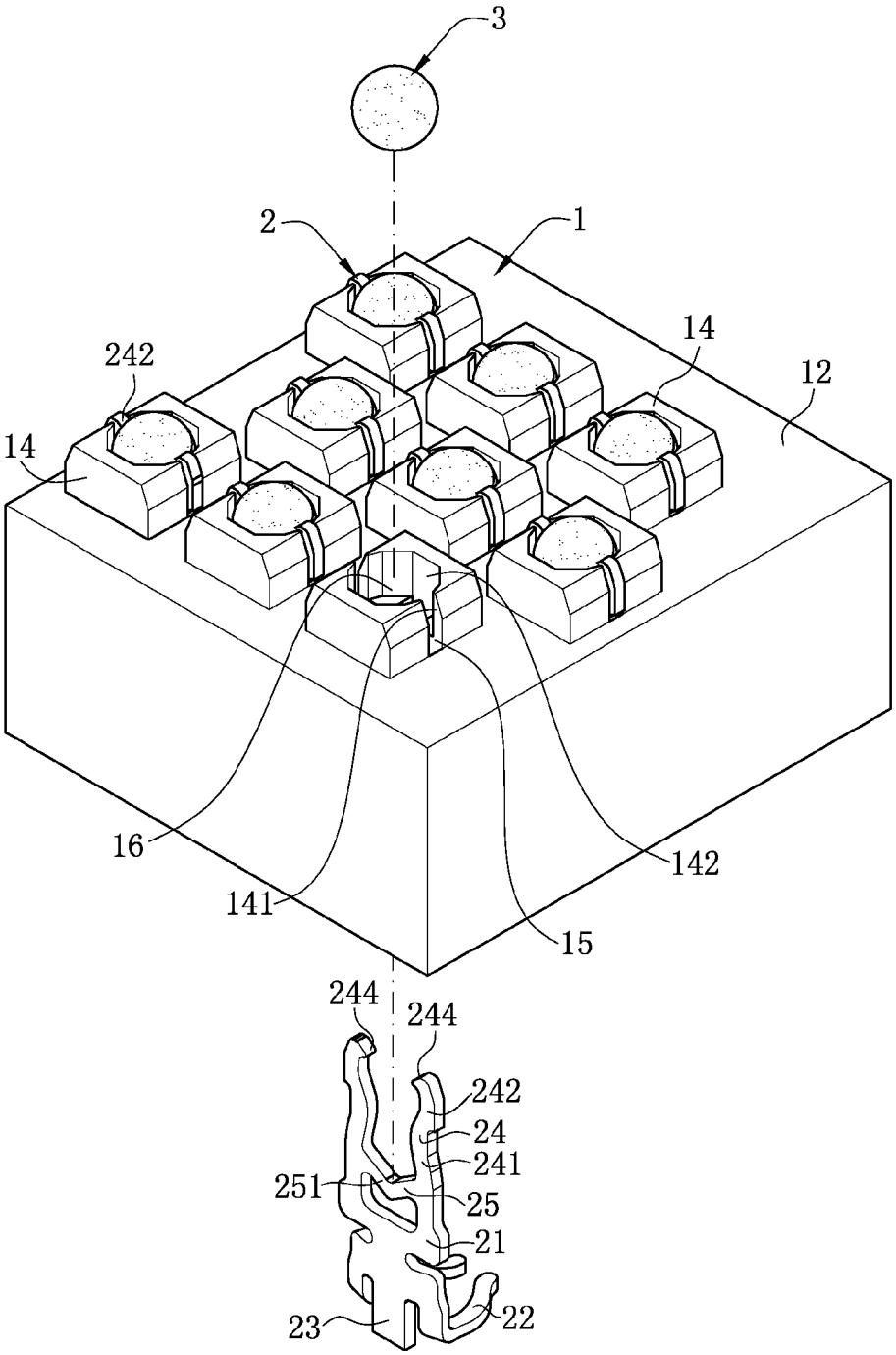
FIG. 2 is a three-dimensional exploded view of an electrical connector viewed from another angle according to one embodiment of the present invention.
Figure 5:
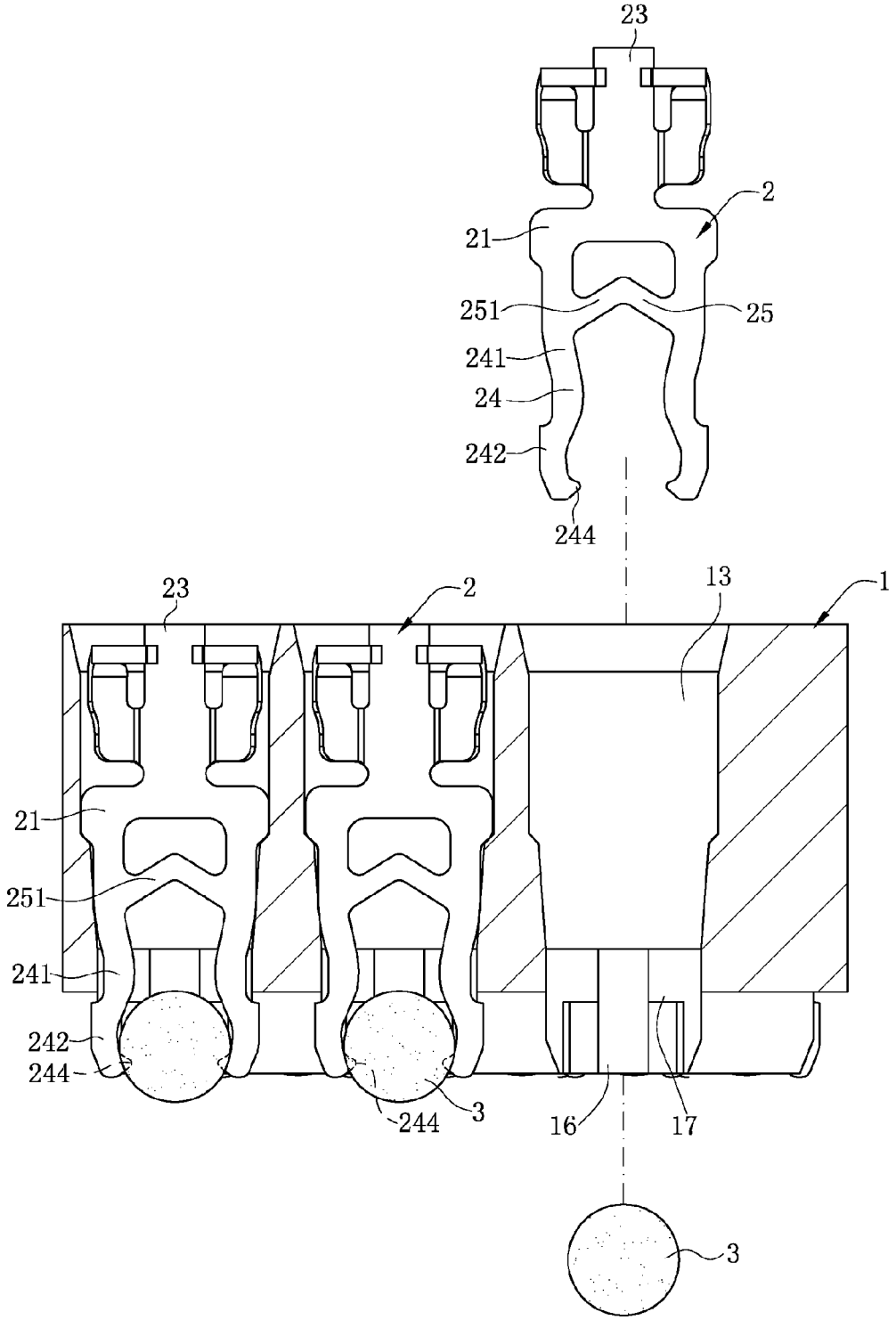
FIG. 5 is a sectional view in which a terminal clamps a tin ball in the electrical connector according to one embodiment of the present invention.

As shown in FIG. 1 and FIG. 2, the body 1 is made of an insulating material. The body 1 has a top surface 11 and a bottom surface 12 disposed opposite to each other. Multiple receiving holes 13 are formed downward and run through the top surface 11 to the bottom surface 12. The receiving holes 13 are used for receiving the terminals 2. At least two protruding blocks 14 protrude downward from the bottom surface 12. In this embodiment, the two protruding blocks 14 are disposed around the receiving hole 13. A gap 15 exists between the two protruding blocks 14. Each of the protruding blocks 14 is provided with a stopping surface 141 toward the gap 15. Each one of the protruding blocks 14 has a depressed portion 142 depressed from the stopping surface 141 in a direction away from the other one of the protruding blocks 14. The depressed portions 142 defines an accommodating space 16 used for accommodating a tin ball 3. In this embodiment, the accommodating space 16 is formed into an octagon, where at least two edges urge against the tin ball 3. As shown in FIG. 5, at least one protruding portion 17 protrudes from the receiving hole 13 at a location close to the bottom surface 12 from the inner wall of the receiving hole 13 toward the middle. The protruding portion 17 can stop the top of the tin ball 3, to prevent the tin ball 3 from being excessively displaced upward.

As shown in FIG. 1 and FIG. 5, the terminal 2 is formed by integrally stamping a metal material. The terminal 2 has a fixing portion 21 fixed in the receiving hole 13. Two contact portions 22 are bent upward and extend from the fixing portion 21. The two contact portions 22 are transversely bent and extend toward each other. A strip-connecting portion 23 extends vertically and upward from the fixing portion 21, and the strip-connecting portion 23 is located between the two contact portions 22. When the terminal 2 is mounted into the receiving hole 13, the strip-connecting portion 23 is attached to the inner wall of the receiving hole 13. Two clamping arms 24 used for clamping the tin ball 3 extend vertically and downward from the fixing portion 21, and the clamping arms 24 and the fixing portion 21 are located in a same vertical plane. In this embodiment, the clamping arms 24 and the fixing portion 21 are formed by integrally blanking a plate material. A connecting arm 25 connected to the two clamping arms 24 exists between the two clamping arms 24. The connecting arm 25 is located below the fixing portion 21, and a space exists between the connecting arm 25 and the fixing portion 21. When the clamping arms 24 clamp the tin ball 3, the clamping arms 24 are propped open by the tin ball 3. In this case, the clamping arms 24 are elastically deformed outward, and their deformation fulcrum is shifted downward from the fixing portion 21 to a location where the connecting arm 25 and the clamping arms 24 are connected, such that the force arms are short, and fatigue of the clamping arms 24 are prevented. The connecting arm 25 includes two connecting portions 251 respectively connected to the two clamping arms 24. An included angle is formed between the two connecting portions 251, and the included angle is preferably an obtuse angle. Viewing from the direction of the plate surface of the terminal 2, the connecting arm 25 is V-shaped. When the two clamping arms 24 are propped open by the tin ball 3, the connecting arm 25 accordingly limits the open displacement of the two clamping arms 24, to prevent them from being excessively deformed outward, such that the clamping arms 24 will not be fatigued because of excessive elastic deformation, a good elastic clamping effect can be kept, and the tin ball 3 can be stably clamped, thereby ensuring the soldering quality of the electrical connector.

Figure 3:
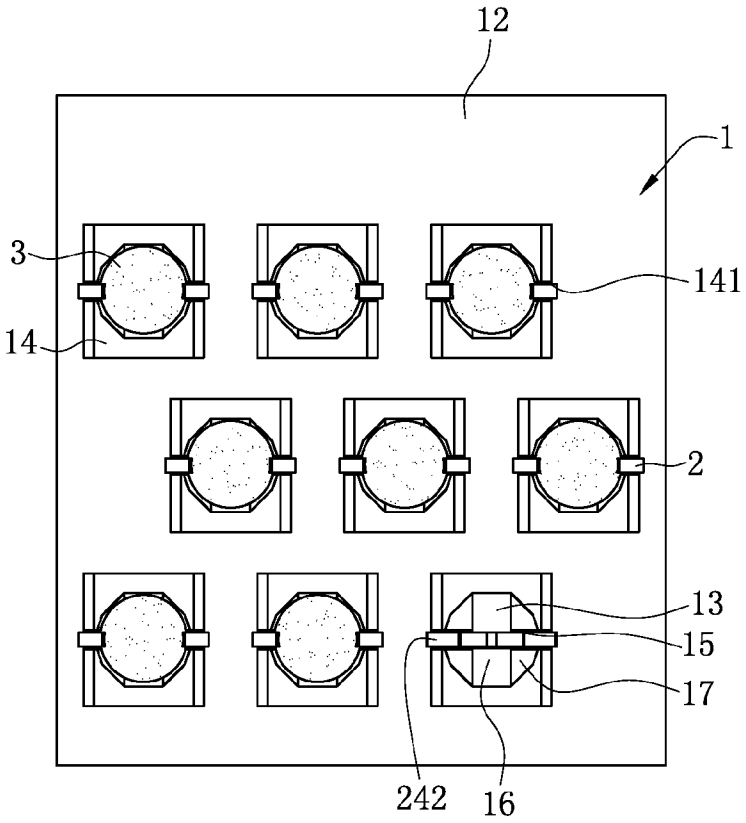
FIG. 3 is a bottom view of an electrical connector according to one embodiment of the present invention.
Figure 4:
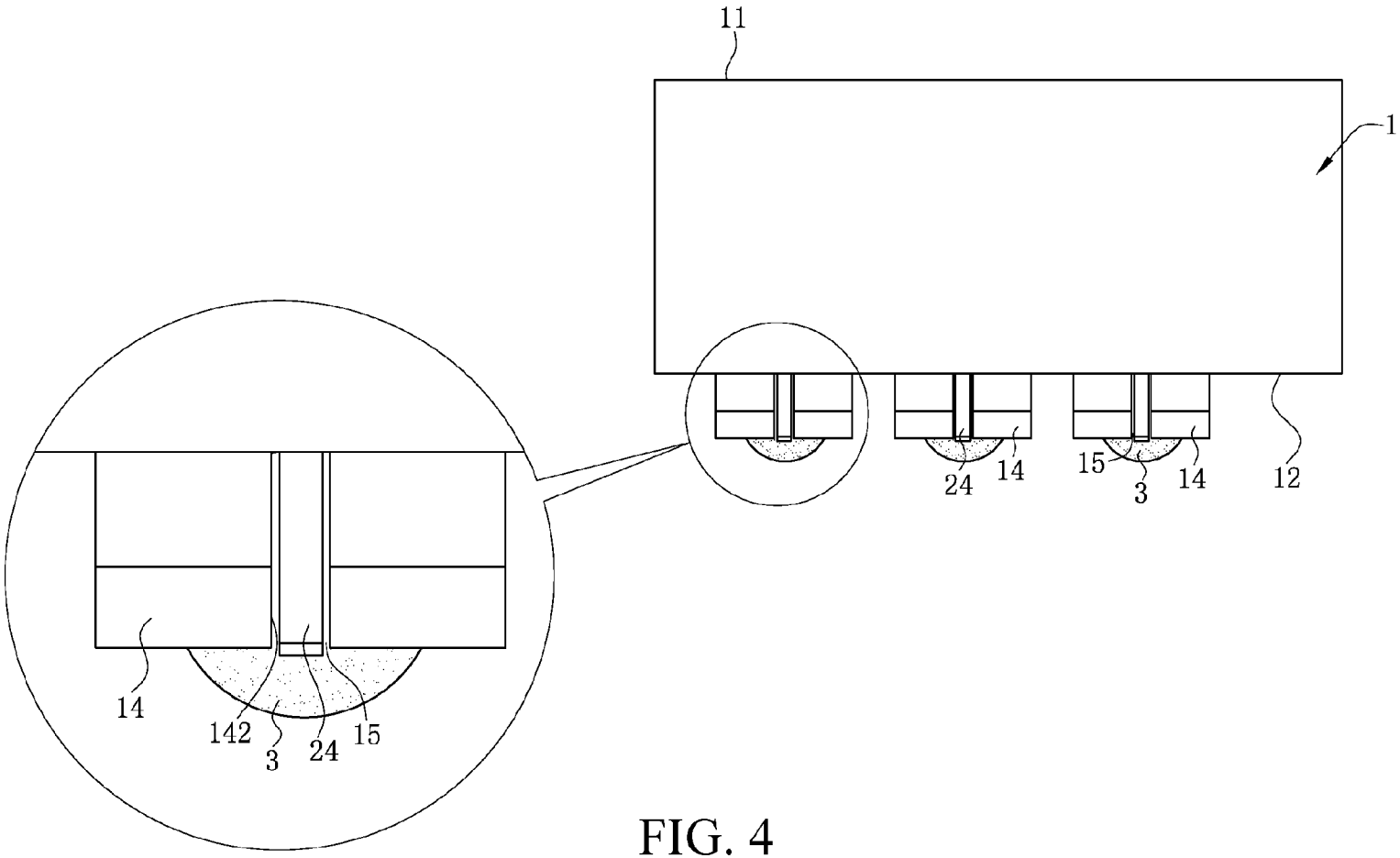
FIG. 4 is a side view of an electrical connector according to one embodiment of the present invention.

As shown in FIGS. 1, 3 and 4, each of the clamping arms 24 includes an extending portion 241 extending downward from the fixing portion 21, and a clamping portion 242 extending downward from the extending portion 241. The extending portions 241 are located in the receiving hole 13. In this embodiment, the connecting arm 25 is connected to the two extending portions 241. The clamping portions 242 extend out from the bottom of the bottom surface 12, and are located in the gap 15. When the tin ball 3 is loaded into the accommodating space 16, the clamping portions 242 clamp the tin ball 3 at the diameter thereof. In this case, the clamping arms 24 are opened by the tin ball 3, and elastically deformed outward in the gap 15. The clamping portions 242 clamp two opposite sides of the tin ball 3 in the plate surface direction. Meanwhile, the protruding blocks 14 urge against another two opposite sides of the tin ball 3 in the direction perpendicular to that of the plate surface. The clamping arms 24 and the protruding blocks 14 jointly define the accommodating space 16, so as to tightly fix the tin ball 3. The stopping surfaces 141 are disposed toward the gap 15, and located at two sides of the clamping portion 242. The stopping surfaces 141 can stop the clamping portions 242 to prevent them from being displaced in a plate thickness direction, so that the two clamping arms 24 will not be dislocated or deflected, and the two clamping arms 24 can stably clamp the diameter location of the tin ball 3. A distance between the two stopping surfaces 141 is slightly greater than the thickness of the clamping arm 24, so that the clamping arm 24 not only can conveniently enter the gap 15, but also can be stopped by the stopping surfaces 141. In one embodiment, a distance between the clamping arm 24 and the stopping surface 141 is less than the thickness of the clamping arm 24, and when the clamping arm 24 is subject to a force, the displacement thereof in the plate thickness direction is stopped by the stopping surface 141, and dislocation or distortion will not be generated. Hook portions 244 facing each other protrude from the bottom ends of the clamping portions 242 respectively, and the hook portions 244 enter the tin ball 3, so as to fix the tin ball 3.

As shown in FIG. 1 and FIG. 5, when the electrical connector is assembled, the terminal 2 is loaded into the receiving hole 13 from top to downward. The fixing portion 21 is fixed to the inner wall of the receiving hole 13, the clamping portions 242 extends out from the bottom surface 12 and is located in the gap 15, and the stopping surfaces 141 are located at two sides of the clamping portions 242 in the plate thickness direction. Then the tin ball 3 is loaded into the accommodating space 16 from bottom upward. The tin ball 3 props the clamping portions 242 open to make them elastically deformed in the direction perpendicular to the plate thickness direction. When the tin ball 3 is loaded upward to urge against the protruding portion 17, it is mounted in place. In this case, two sides of the tin ball 3 are clamped by the clamping arms 24, another two opposite sides urge against two opposite sides of the protruding blocks 14. The protruding blocks 14 and the clamping arms 24 jointly clamp the tin ball 3. The hook portions 244 are penetrated into the tin ball 3, so as to stably hold the tin ball 3 in the accommodating space 16, and prevent the tin ball 3 from falling off. In the process that the tin ball 3 props the clamping arms 24 open, if the clamping arms 24 are moved or deformed in the direction perpendicular to the plate thickness direction, the movement will be stopped by the stopping surfaces 141, to prevent dislocation, distortion or deflection between the two clamping arms 24.

In summary, the electrical connector according to certain embodiments of the present invention, among other things, has the following beneficial advantages.

(1) The stopping surfaces 141 are disposed toward the gap 15, and located at two sides of the clamping portions 242. The stopping surfaces 141 can stop the clamping portions 242, to prevent them from being displaced in a plate thickness direction, so that the two clamping arms 24 will not be dislocated or deflected, and the two clamping arms 24 can stably clamp the diameter location of the tin ball 3.

(2) A distance between the clamping arm 24 and the stopping surface 141 is less than the thickness of the clamping arm 24. When the clamping arm 24 is subject to a force, the displacement thereof in the plate thickness direction is stopped by the stopping surface 141, and dislocation or distortion will not be generated.

(3) A connecting arm 25 connected to the two clamping arms 24 exists between the two clamping arms 24. When the clamping arms 24 clamp the tin ball 3, the clamping arms 24 are propped open by the tin ball 3. In this case, the clamping arms 24 are elastically deformed outward, and their deformation fulcrum is shifted downward from the fixing portion 21 to a location where the connecting arm 25 and the clamping arm 24 are connected, such that the force arms are short, and fatigue of the clamping arms 24 are prevented.

(4) The connecting arm 25 includes two connecting portions 251 respectively connected to the two clamping arms 24, and an included angle is formed between the two connecting portions 251. When the two clamping arms 24 are propped open by the tin ball 3, the connecting arm 25 is accordingly opened, and limits the open displacement of the two clamping arms 24, to prevent them from being excessively deformed outward. The clamping arms 24 will not fatigue because of excessive elastic deformation, and a good elastic clamping effect can be kept, such that the tin ball 3 can be stably clamped, thereby ensuring the soldering quality of the electrical connector.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a body, having a top surface and a bottom surface opposite to each other, a plurality of receiving holes running through the body from the top surface to the bottom surface, and at least two protruding blocks protruding downward from the bottom surface and located around each of the receiving hole; and at least one terminal received in the receiving hole, and having a fixing portion and two clamping arms extending downward from the fixing portion along a plate surface for clamping a tin ball, wherein a gap exists between the two protruding blocks, and each of the protruding blocks has a stopping surface facing toward the gap; and wherein bottom ends of the two clamping arms are located in the gap, and the stopping surfaces are configured to stop the clamping arms and prevent the clamping arms from moving in a plate thickness direction.

2. The electrical connector of claim 1, wherein a distance between the clamping arm and the stopping surface is less than a thickness of the clamping arm.

3. The electrical connector of claim 1, wherein each of the protruding blocks comprises a depressed portion depressed from the stopping surface in a direction away from the other of the protruding blocks, and the depressed portions and the clamping arms jointly define an accommodating space for accommodating the tin ball.

4. The electrical connector of claim 3, wherein the accommodating space is formed into an octagon, and two protruding blocks and the clamping arms jointly clamp the tin ball.

5. The electrical connector of claim 1, wherein the clamping arms are elastically deformable in the gap, and when the tin ball is mounted to the clamping arms, the clamping arms are elastically deformed outward in a direction perpendicular to the plate thickness direction.

6. The electrical connector of claim 1, wherein each of the clamping arms comprises an extending portion connected to the fixing portion, and a clamping portion extending downward from a lower end of the extending portion, and the clamping portions clamp the tin ball.

7. The electrical connector of claim 6, wherein the extending portions are located in the receiving hole, and the clamping portions extend out from the bottom surface and are located in the gap.

8. The electrical connector of claim 1, wherein each of the two clamping arms comprises a hook portion protruding from an end of the clamping arm, and the hook portions face each other and are inserted into the tin ball.

9. The electrical connector of claim 1, further comprising a connecting arm disposed between the two clamping arms, and connected to the two clamping arms, to increase the strength of the two clamping arms, the connecting arm is located below the fixing portion, and a space exists between the connecting arm and the fixing portion.

10. The electrical connector of claim 9, wherein the connecting arm comprises two connecting portions respectively connected to the two clamping arms, and an included angle is formed between the two connecting portions.

11. The electrical connector of claim 9, wherein the connecting arm is V-shaped.

12. The electrical connector of claim 1, further comprising at least one protruding portion protruding in the receiving hole, wherein the protruding portion stops the top of the tin ball to prevent the tin ball from excessively moving upward.

13. The electrical connector of claim 1, wherein the clamping arms and the fixing portion are coplanar.

14. The electrical connector of claim 1, wherein two clamping arms are symmetrical about a center of the tin ball from a bottom view.

* * * * *